US008805587B1

(12) United States Patent
Elshafei et al.

(10) Patent No.: US 8,805,587 B1
(45) Date of Patent: Aug. 12, 2014

(54) METHOD FOR OPTIMIZING AND CONTROLLING PRESSURE IN GAS-OIL SEPARATION PLANTS

(71) Applicant: King Fahd University of Petroleum and Minerals, Dhahran (SA)

(72) Inventors: Moustafa Elshafei Ahmed Elshafei, Dhahran (SA); Mahmoud El Awady Doklah, Dhahran (SA)

(73) Assignee: King Fahd University of Petroleum and Minerals, Dhahran (SA)

( * ) Notice: Subject to any disclaimer, the term of this patent is extended or adjusted under 35 U.S.C. 154(b) by 0 days.

(21) Appl. No.: 14/072,775

(22) Filed: Nov. 5, 2013

(51) Int. Cl.

| | |
|---|---|
| ***G05B 13/00*** | (2006.01) |
| ***G05B 17/00*** | (2006.01) |
| ***G05B 13/04*** | (2006.01) |
| *G05B 21/00* | (2006.01) |

(52) U.S. Cl.
CPC ..... *C01G 7/12* (2013.01)
USPC ..... 700/273; 700/266

(58) Field of Classification Search
None
See application file for complete search history.

(56) References Cited

U.S. PATENT DOCUMENTS

| | | | |
|---|---|---|---|
| 5,132,011 | A | 7/1992 | Ferris |
| 8,133,300 | B1 | 3/2012 | Gonsalves, III et al. |
| 8,346,693 | B2 | 1/2013 | Al-Duwaish et al. |
| 2009/0182693 | A1 | 7/2009 | Fulton et al. |
| 2011/0125687 | A1 | 5/2011 | Al-Duwaish et al. |

FOREIGN PATENT DOCUMENTS

| | | | |
|---|---|---|---|
| CN | 101944141 | A | 1/2011 |
| JP | 2011144753 | A | 7/2011 |

OTHER PUBLICATIONS

M. Elshafei, A. Khouki and A. Abdulraheem, "Neural network aided design of oil production units", Information Sciences Signal Processing and their Applications (ISSPA), 2010 10th International Conference on, May 10-13, 2010, pp. 638-641.

A. Khouki, M. Oloso, M. Elshafei, A. Abdulraheem, A. Al-Majed, "Support Vector Regression and Functional Networks for Viscosity and Gas/Oil Ratio Curves Estimation", International Journal of Computational Intelligence and Applications (IJCIA), vol. 10, Iss. 3 (2011) pp. 269-293.

*Primary Examiner* — Neil N Turk
(74) *Attorney, Agent, or Firm* — Richard C Litman

(57) ABSTRACT

The method for optimizing and controlling pressure in gas-oil separation plants utilizes a genetic algorithm-based control method for controlling pressure in each stage of a multi-stage gas-oil separation plant to optimize oil production parameters. A neural network simulation model is used with an optimization procedure to provide on-line operation optimization of the multi-stage gas-oil separation plant. Pressure set points of each stage are automatically and continuously adjusted in the presence of fluctuating ambient temperatures and production rates to ensure optimal oil recovery and optimal quality of the produced oil.

1 Claim, 8 Drawing Sheets

| Well A Pres=382 psi, Tres=220 F | | | | | | |
|---|---|---|---|---|---|---|
| Test case | $P_{in}$ | $T_{in}$ | $P_s$ | $T_s$ | Predicted GOR | Reported GOR |
| Test case 1 | | Ta= 130 | | | | |
| Stg1 | 382 | 220 | 50 | 140 | 85.01 | 85 |
| Stg2 | 50 | 140 | 0 | 130 | 51.1 | 52 |
| | | | | Total | 136.11 | 137 |
| Optimized | | | | | | |
| Stg1 | 382 | 220 | 145.7 | 165 | 38.11 | 85 |
| Stg2 | 145.7 | 165 | 0 | 130 | 72.67 | 52 |
| | | | | | 110.78 | 137 |
| Test case 2 | | Ta= 75 | | | | |
| Stg1 | 382 | 220 | 50 | 80 | 62.5 | 53 |
| Stg2 | 50 | 80 | 0 | 75 | 51.2 | 49 |
| | | | | Total | 113.7 | 102 |
| Optimized | | | | | | |
| Stg1 | 382 | 220 | 138.92 | 165 | 40.5 | 53 |
| Stg2 | 138.92 | 165 | 0 | 75 | 38.07 | 49 |
| | | | | | 78.57 | 102 |
| | | | | | | |
| Well B, Pres = 1920 psi, Tres = 215 F | | | | | | |
| Test case 1 | | Ta = 110 F | | | | |
| | $P_{in}$ | $T_{in}$ | $P_s$ | $T_s$ | Predicted GOR | Reported GOR |
| Stg1 | 1920 | 215 | 250 | 130 | 504.62 | 507 |
| Stg2 | 250 | 130 | 50 | 120 | 122.03 | 112 |
| Stg3 | 50 | 120 | 0 | 110 | 71.33 | 66 |
| | | | | Total | 697.98 | 685 |
| Optimized | | | | | | |
| Stg1 | 1920 | 215 | 474.2 | 135.62 | 400.09 | 507 |
| Stg2 | 474.2 | 135.62 | 100 | 125.6 | 162.98 | 112 |
| Stg3 | 100 | 125.6 | 0 | 110 | 97.50 | 66 |
| | | | | | 660.57 | 685 |
| Test case 2 | | Ta = 80 F | | | | |
| Stg1 | 1920 | 215 | 250 | 100 | 440.02 | 466 |
| Stg2 | 250 | 100 | 50 | 90 | 117.65 | 117 |
| Stg3 | 50 | 90 | 0 | 80 | 69.41 | 76 |
| | | | | Total | 627.08 | 659 |
| Optimized | | | | | | |
| Stg1 | 1920 | 215 | 250 | 95 | 428.98 | 466 |
| Stg2 | 250 | 95 | 100 | 85 | 46.25 | 117 |
| Stg3 | 100 | 85 | 0 | 80 | 104.03 | 76 |
| | | | | | 578.26 | 659 |
| | | | | | | |

*Fig. 9*

METHOD FOR OPTIMIZING AND CONTROLLING PRESSURE IN GAS-OIL SEPARATION PLANTS

BACKGROUND OF THE INVENTION

1. Field of the Invention

The present invention relates to oil refineries, and particularly to a method for optimizing pressure in gas-oil separation plants that uses a genetic algorithm to optimize oil production parameters.

2. Description of the Related Art

Gas-Oil Separation Plants (GOSPs) are very common in oil production facilities. A GOSP typically includes a cascade of vessels through which the pressure of extracted oil is reduced in steps or stages from relatively high well pressure to atmospheric pressure. The selection of the operating pressure of each of these vessels is very important for maximizing hydrocarbon liquid recovery from a given well. The choice of the number of stages and the pressure/temperature of each stage is typically based on laboratory experiments, generally referred to as "separator tests". These separator tests, however, are time-consuming and costly to perform.

FIG. 2 shows a typical multi-stage separator plant 200. In this plant, the oil is brought from the reservoir with initial reservoir conditions of reservoir pressure $P_{res}$ and reservoir temperature $T_{res}$ to the ambient temperature and pressure ($P_a$, $T_a$), respectively, in four steps at specified temperatures and pressures; i.e., ($P_1$, $T_1$), ($P_2$, $T_2$), ($P_3$, $T_3$) and ($P_a$, $T_a$). At each stage, the liberated gas is collected, and the relevant values are recorded. The initial gas-oil mixture is extracted from the oil reservoir through the oil well 202, where it passes through the first separator or stage 204 with conditions ($P_1$, $T_1$). The liquid is then sent to the second stage 206 ($P_2$, $T_2$) and third stage 208 ($P_3$, $T_3$) sequentially, where the gas is collected again for compression and use as natural gas liquids (NGL plant) 212. Finally, at the last stage 210, the total volume of the collected gas is divided by the remaining liquid in barrels, called "stock tank oil" (STO). The final gas-to-oil ratio (GOR) is referred to as the separator solution GOR, $R_s$.

During initial testing, a laboratory test, commonly known as the separator test, is performed primarily to determine the oil/gas separation stages to bring oil from the reservoir conditions to the ambient temperature conditions. In oil production, several tests are usually performed using an oil sample at different separator conditions and from differing numbers of separation stages in an effort to ascertain the conditions that can maximize liquid oil production and reduce the amount of escaped gas. The collected gas is considered, in this case, to be a secondary product of lower economic value. On the other hand, the more light components lost in the separator stages, the lower economic value of the remaining oil, as this oil becomes heavier.

The oil specific gravity in the API scale (established by the American Petroleum Institute) is typically used as a measure of the oil quality. A higher value indicates a lighter oil and, thus, a higher market value. Another important performance parameter of the GOSP is known as the "formation volume factor" (FVF), or Bo. The oil formation volume factor is defined as the ratio of the volume of oil at reservoir (in situ) conditions to that at stock tank conditions. This factor is used to determine the well oil flow rate to the production flow rate of the oil (at stock tank conditions).

These three parameters (GOR, API and FVF) are important in determining the operational costs and the estimated revenue of the plant. The operational cost is directly proportional to the well oil production rate. Thus, FVF should be minimized, while the main revenue is proportional to the API of the STO. Thus, API should be maximized. In oil production, gas is considered a byproduct and is either burned on site or collected and sold, but at a lower price than that of oil. As such, GOR should be minimized.

FIGS. 3A, 3B and 3C show oil API, FVF and GOR, respectively, as functions of separator stage pressure, illustrating how these three performance parameters are affected by proper selection of the operating pressure of the separator vessels. It can be clearly seen that adjustment of the operating pressure is important for optimizing the values of GOR, FVF and API.

An exemplary operational objective function is J=Revenues−operational cost, where:

$$\text{Revenues} = \text{sales of } STO + \text{sales of gas} = f_1(API) \times \frac{P_{wo}}{FVF} + f_2(P_{wo}GOR),$$

and where $$\frac{P_{wo}}{FVF}$$

is the production rate of the STO, $f_1$ (API) is the price of a barrel of oil as a function of oil API, and $f_2(P_{wo}GOR)$ is the sales price of the produced gas. The operational cost is also a function, $f_3(P_{wo})$, which represents the cost of a barrel as a function of oil well production.

It would be desirable to replace costly empirical testing, as described above, with an optimization method based on a user-defined overall operational cost function J=Revenues−operational cost, which could then be optimized by determining operating pressures that select the best values for FVF, GOR and API.

FIG. 4 illustrates a separator stage vessel 300 in greater detail than that shown in FIG. 2. Inlet flow is received via a pipe or conduit 302. The conditions $P_{in}$ and $T_{in}$ represent the pressure and temperature, respectively, of the incoming oil from the previous stage, or from the oil well if the stage is the first one. The collected oil is taken to the second stage through pipe 304, where the rate of flow is controlled by a control valve 306. The rate of oil flow is governed by a feedback control loop to maintain the oil level at a specified set point. The control loop contains a level sensor 310 and a controller 312. The controller takes the measured level value and compares it with the desired set point value 314, and calculates the adjustment position of the control valve 306 to change the oil flow to keep the level of oil in the vessel within the desired range. The stage pressure and temperature are denoted as $P_s$ and $T_s$, respectively.

The stage temperature is measure by a temperature sensor 316. $T_a$ is the ambient temperature, which directly affects the operation of the stage due to the heat loss to the ambient environment. The pressure of the stage $P_s$ is controlled via a pressure control loop, where a pressure sensor 318 measures $P_s$, the stage pressure, and sends it to a controller 320. The controller compares the stage pressure with the desired set point pressure 322 of the stage and adjusts the gas flow via control valve 324. In the majority of GOSPs, the pressure set points are determined at the design stage and kept fixed during the plant operation. The ratio of the separated gas to the collected oil is the stage gas-to-oil ratio. The collected oil becomes the inlet to the next stage, and so on.

The released gas in every stage is a complex function of the flow rate, inlet temperature and pressure, along with the stage pressure and temperature. The stage temperature is similarly a complicated function of the above-mentioned parameters and fluctuates with the ambient temperature between day and night, and between summer and winter.

Thus, a method for optimizing and controlling pressure in gas-oil separation plants solving the aforementioned problems is desired.

SUMMARY OF THE INVENTION

The method for optimizing and controlling pressure in gas-oil separation plants utilizes a genetic algorithm-based control method for controlling pressure in each stage of a multi-stage gas-oil separation plant to optimize oil production parameters. A neural network simulation model is used with an optimization procedure to provide on-line operational optimization of the multi-stage gas-oil separation plant. Pressure set points of each stage are automatically and continuously adjusted in the presence of fluctuating ambient temperatures and production rates to ensure optimal oil recovery and optimal quality of the produced oil.

The method includes the following steps: (a) receiving oil composition and a set of stage temperature data from a multi-stage gas-oil separation plant and storing the oil composition and the set of stage temperature data in computer readable memory; (b) establishing a vector x, where each element of the vector x corresponds to a pressure value of one of the stages of the multi-stage gas-oil separation plant, each pressure value being dependent upon the oil composition and the stage temperature associated with the corresponding stage, the vector x being stored in the computer readable memory; (c) establishing an objective function J such that $$J = \sum_{i=1}^{Q} |y_{mi} - y_{di}|^2,$$

where Q represents a number of neural network training data points, $y_{mi}$ represents an i-th predicted output, and $y_{di}$ represents an i-th target output; (d) establishing a set of M nonlinear radial basis functions $\phi_i(x)$, where M is an integer and $\phi_i(x)$ represents the i-th radial basis function, where i=0, 1, 2, . . . , M; (e) generating a neural network output y as $$\varphi_i(x) = \exp\left(\frac{\|x - C_i\|^2}{\sigma_i^2}\right),$$

where $\beta_i$ is an i-th weight and the radial basis function $\phi_i(x)$ is calculated as:

$$y = \sum_{i=0}^{M} \beta_i \varphi_i(x),$$

where $C_i$ represents an i-th radial basis center and $\sigma_i$ represents an i-th center spread, the neural network output y being stored in the computer readable memory and the i-th radial basis center being determined by data clustering, where the weights $\beta_i$ are selected to minimize the objective function J; (f) separating the output y into a low pressure output $y_L$ corresponding to stage pressures below 250 psi and a high pressure output $y_H$ corresponding to stage pressures between 250 psi and 3,600 psi; (g) calculating a stage gas-to-oil ratio GOR as $GOR=\alpha_1 y_L+\alpha_2 y_H$, where $\alpha_1$ and $\alpha_2$ are stage pressure dependent parameters such that $\alpha_2=0$ for a stage pressure $P_s$ than 150 psi, $\alpha_2=(P_s-150)/200$ for a stage pressure $P_s$ between 150 psi and 350 psi, and $\alpha_2=1$ for a stage pressure $P_s$ greater than 350 psi, and $\alpha_1=1-\alpha_2$; (h) calculating a desired stage pressure for each of the stages to reach a desired stage gas-to-oil-ratio based upon the calculated gas-to-oil ratio; (i) transmitting control signals to each of the stages to adjust the stage pressure therein based upon the calculated desired stage pressure; j) updating the weights $\beta_i$, as:

$$\beta_i = \beta_i + \frac{\mu}{\sigma M}(GOR_{measured} - GOR)\phi_i \text{ for } i = 0, 1, 2, \ldots, M,$$

where $GOR_{measured}$ represents a gas-to-oil ratio measured at each of the stages, $\sigma$ represents a center spread such that:

$$\sigma^2 = \frac{1}{M}\sum_{i=1}^{M} \phi_i^2,$$

and $\mu$ is a parameter selected such that $0<\mu<1$; and (k) returning to step (e) after a user-defined waiting period.

These and other features of the present invention will become readily apparent upon further review of the following specification.

BRIEF DESCRIPTION OF THE DRAWINGS

FIG. 9 is a table comparing experimental separator test data against predicted values generated by the method for optimizing and controlling pressure in gas-oil separation plants according to the present invention.

Similar reference characters denote corresponding features consistently throughout the attached drawings.

DETAILED DESCRIPTION OF THE PREFERRED EMBODIMENTS

Figure 1:
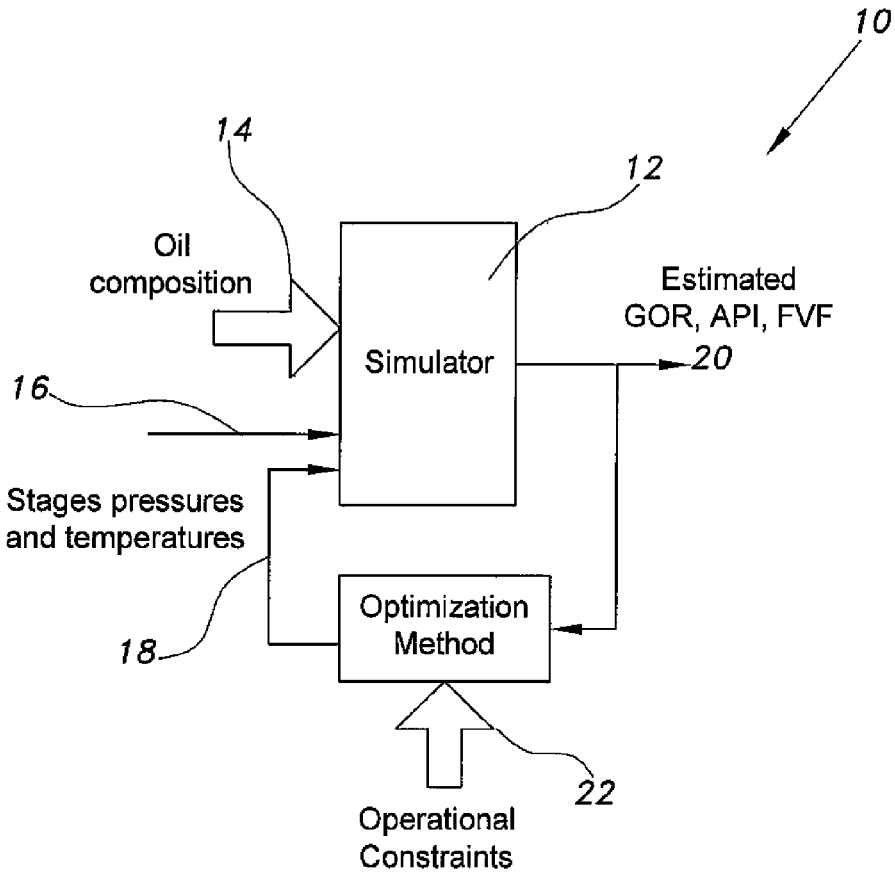
FIG. 1 block diagram showing a method for optimizing and controlling pressure in gas-oil separation plants according to the present invention.
Figure 2:
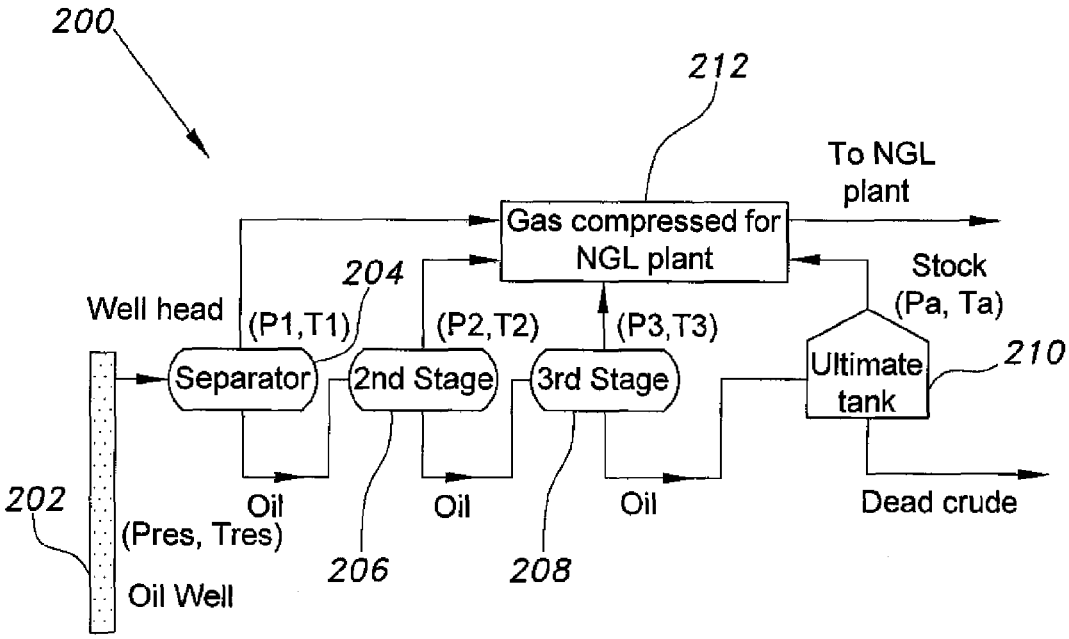
Fig. 2 Prior Art
FIG. 2 is a block diagram illustrating a typical prior art multi-stage gas-oil separation plant.
Figure 3A:
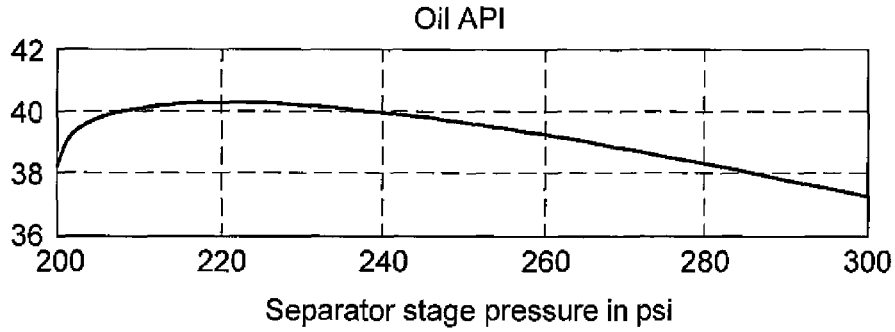
FIG. 3A, FIG. 3B and FIG. 3C, respectively, illustrate dependence of oil API, FVF and GOR on separator stage pressure in the multi-stage gas-oil separation plant of FIG. 2.
Figure 3B:
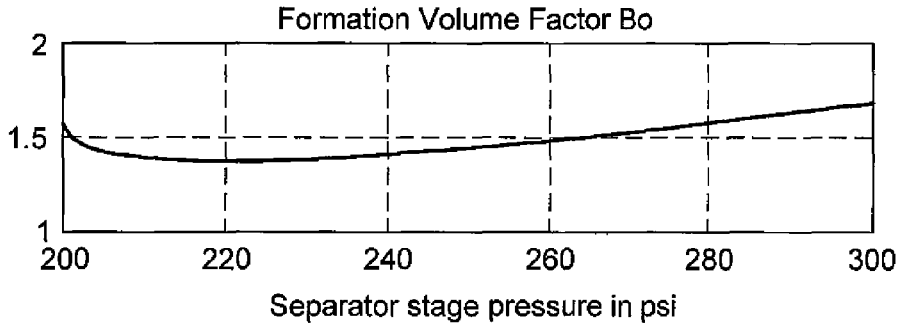
Figure 3C:
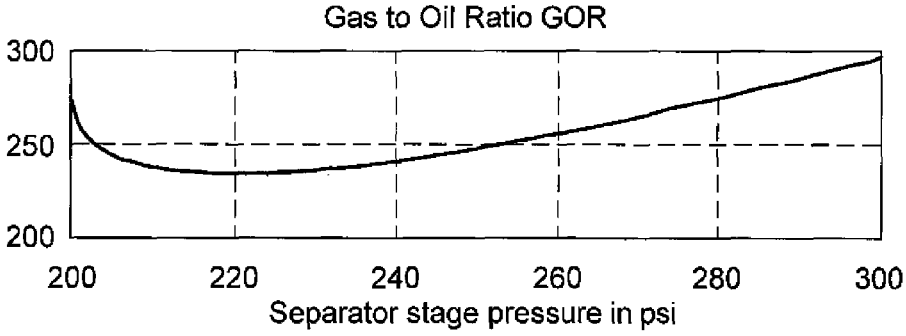
Figure 4:
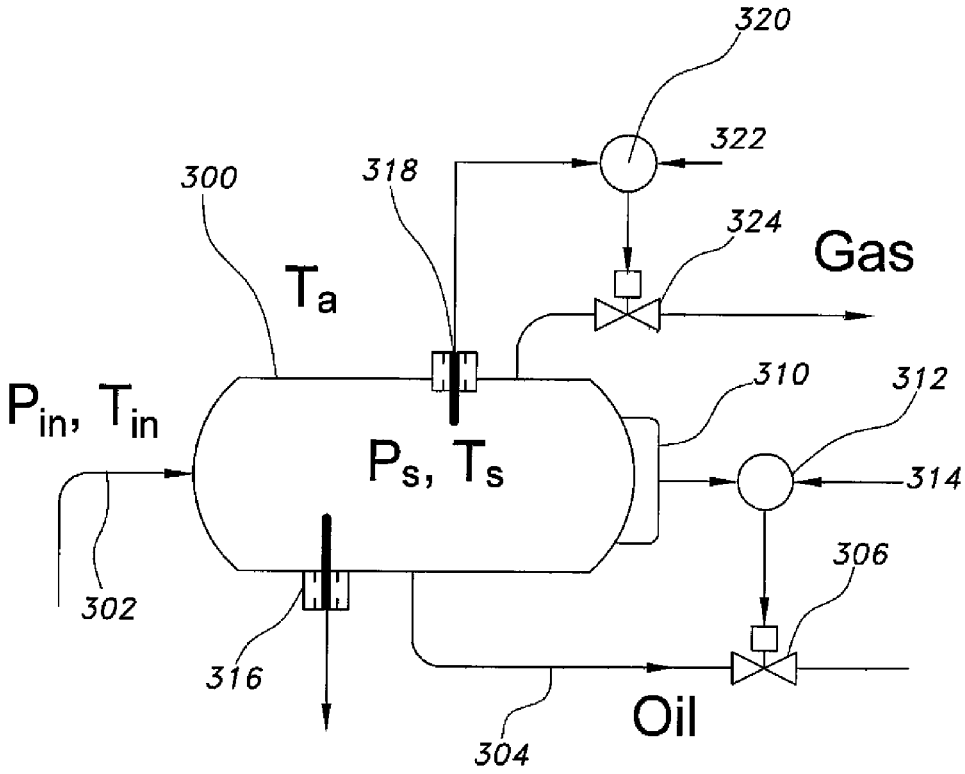
Fig. 4 Prior Art
FIG. 4 is a schematic diagram illustrating control and operation of a single stage of the prior art multi-stage gas-oil separation plant of FIG. 2.

As shown in FIG. 1, a system 10 for implementing a method for optimizing and controlling pressure in gas-oil separation plants includes a predictor 12 in the form of a simulator of a separator (such as separator 300 of FIG. 4) that takes into consideration the oil composition 14, the stage's actual operating temperatures 16, and the stage's pressures 18. The predictor 12 estimates the gas-to-oil ratio 20, FVF (formation volume factor), and API (oil specific gravity in the American Petroleum Institute scale). The system 10 utilizes a search-based optimization method. The method generates possible values of stage pressures 18 within the operational constraints 22, and evaluates an objective function of the estimated GOR, API and FVF. The optimization procedure changes the generated values of pressures in the direction of minimizing the objective function until it reaches the optimal value. The optimal values of the stage's pressure can then be displayed on an operator display, such as the display 118 in FIG. 5, or sent directly as set points (parameters 322 in FIG. 4) to the pressure controllers 320.

Figure 5:
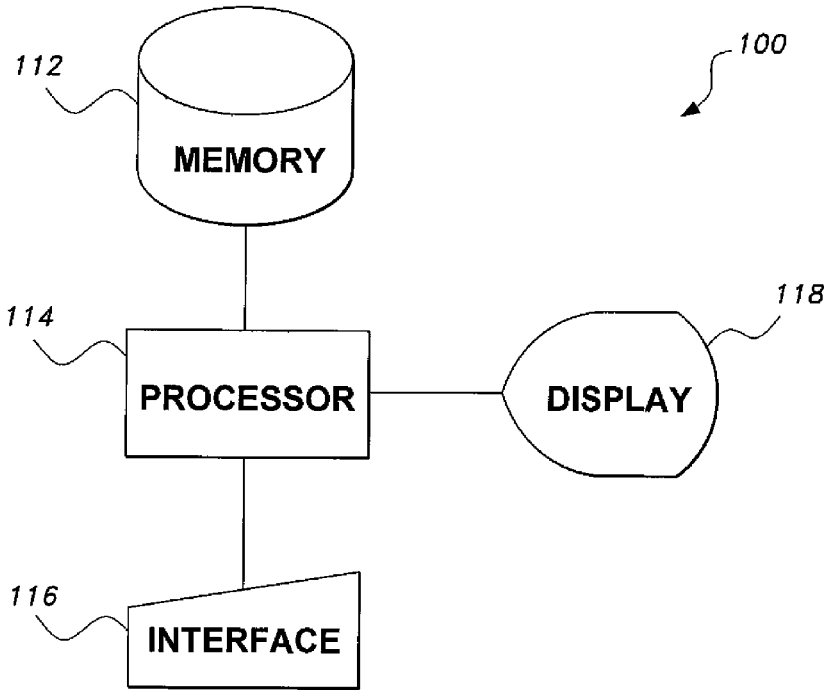
FIG. 5 is a block diagram illustrating system components for implementing the method for optimizing and controlling pressure in gas-oil separation plants according to the present invention.

It should be understood that the calculations of the optimization method may be performed by any suitable computer system, such as that diagrammatically shown in FIG. 5. Data is entered into the system 100 via any suitable type of user interface 116, and may be stored in memory 112, which may be any suitable type of computer readable and programmable memory and is preferably a non-transitory, computer readable storage medium. Calculations are performed by a processor 114, which may be any suitable type of computer processor, and may be displayed to the user on display 118, which may be any suitable type of computer display.

The processor 114 may be associated with, or incorporated into, any suitable type of computing device, for example, a personal computer or a programmable logic controller. The display 118, the processor 114, the memory 112 and any associated computer readable recording media are in communication with one another by any suitable type of data bus, as is well known in the art.

As used herein, the term "computer readable medium" is defined to mean any form of non-transitory storage media, including, e.g., a magnetic recording apparatus, an optical disk, a magneto-optical disk, and/or a semiconductor memory (for example, RAM, ROM, etc.). Examples of magnetic recording apparatus that may be used in addition to memory 112, or in place of memory 112, include a hard disk device (HDD), a flexible disk (FD), and a magnetic tape (MT). Examples of the optical disk include a DVD (Digital Versatile Disc), a DVD-RAM, a CD-ROM (Compact Disc-Read Only Memory), and a CD-R (Recordable)/RW. It should be understood that non-transitory computer-readable storage media include all computer-readable media, but excludes a transitory, propagating signal.

Figure 6:
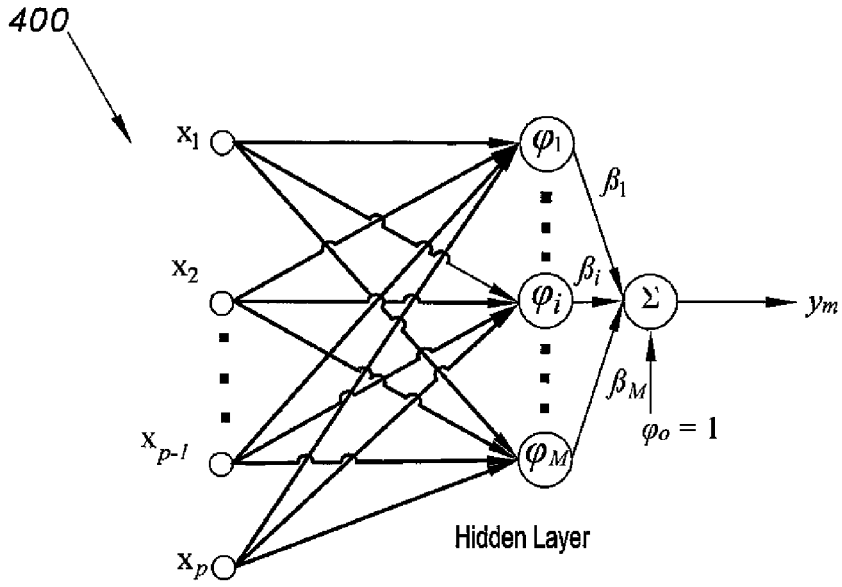
FIG. 6 is a schematic diagram showing the architecture of a radial basis function neural network used in the method for optimizing and controlling pressure in gas-oil separation plants according to the present invention.

Simulator 12 uses two radial basis function neural networks 400, such as those diagrammatically illustrated in FIG. 6. Radial basis function (RBF) networks form a special architecture of neural networks that present important advantages compared to conventional multi-layer perceptron neural networks, including simpler structures and faster learning algorithms. Due to these advantages, RBF networks have been used extensively for modeling a great variety of systems. RBF is a feed-forward neural network model with good performance. Each node of the hidden layer has a parameter vector, called a "center". The centers are determined by clustering the input vectors of the training set.

During recognition, the input vector is compared with the network centers to produce a radically symmetrical response. Responses of the hidden layer are scaled by the connection weights of the output layer and are then combined to produce the network output. For an input vector $X=\{x_1, x_2, \ldots x_p\}$ and a scalar output value y, in order to map the input vector X onto output y, the input vector is presented to the hidden layer of the network, which consists of M nonlinear activation functions satisfying a set of mathematical conditions represented as:

$$v_i=\phi_i(\|X-C_i\|), \tag{1}$$

where $C_i$ represents the basis center, $\|.\|$ represents the Euclidean distance, and $\phi_i$ represents the activation function. The activation function is also known as the "basis function". The outputs $v_i$ of the nonlinear activation functions are combined linearly with a weight vector $\beta$ of the output layer to produce the network output y:

$$y = \sum_{i=0}^{M} \beta_i \varphi_i,\ i = 0, 1, 2, \ldots, M. \tag{2}$$

Although there are several candidate activation functions, the most commonly used function is the Gaussian function, given by:

$$\varphi_i(x) = \exp\left(\frac{\|x - C_i\|^2}{\sigma_i^2}\right), \tag{3}$$

where $\sigma$ is the center spread.

The training procedure of RBF networks is usually performed in two steps. In the first step, the RBF centers are determined using a data-clustering technique. In the second step, the weights $\{\beta_i\}$ are selected to minimize the cost function:

$$\min J = \sum_{i=1}^{Q} |y_{mi} - y_{di}|^2, \tag{4}$$

where Q is the number of the training data points, and $y_m$,$y_d$ are the predicted and target output values, respectively.

In a stage-by-stage prediction of the GOR, one or more RBF neural networks are used to predict the GOR. A multi-stage separator test is then simulated by combining the prediction of GOR of each stage individually. In the present method, two neural networks have been used: one for the difference of pressure up to 250 psi, and the second one for a high range of up to 3,600 psi. To train these two neural networks, the database is divided into two groups according to the above criteria. Further, each group is then divided into a training set and a validation set.

Figure 7:
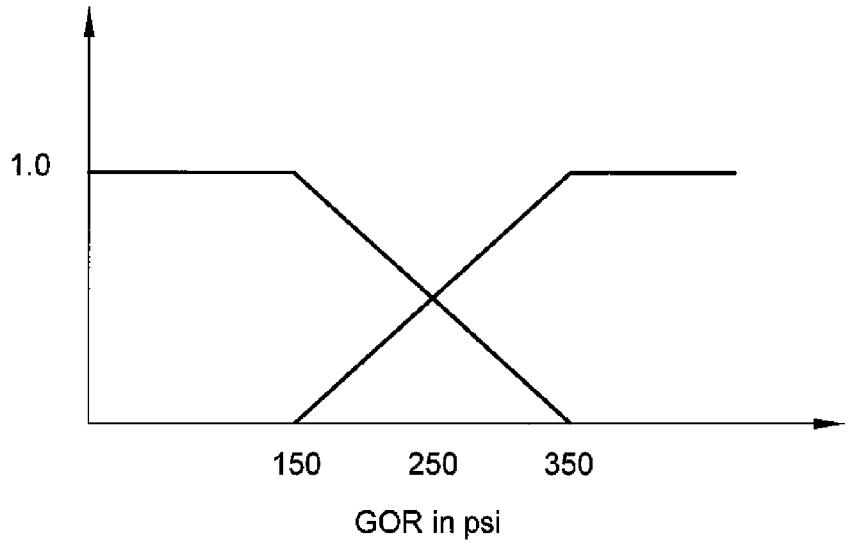
FIG. 7 is a graph comparing fuzzy membership functions for low-range and high-range neural networks of the type illustrated in FIG. 6 used in the method for optimizing and controlling pressure in gas-oil separation plants according to the present invention.

The output of the two networks are then combined using simple fuzzy membership functions, as illustrated in FIG. 7. The stage GOR is then given by $GOR=\alpha_1 y_L+\alpha_2 y_H$, where $y_L$ represents the output for the "low" pressure (up to 250 psi), $y_H$ represents the output for the "high" pressure (up to 3,600 psi), and $$\alpha_2 = \begin{cases} \frac{(\Delta P - 150}{200} & 150 \le \Delta P \le 350 \\ 1 & \text{for } \Delta P \ge 350 \\ 0 & \text{for } \Delta P \le 150 \end{cases} \quad (5)$$

$$\alpha_1 = 1 - \alpha_2$$

Figure 8:
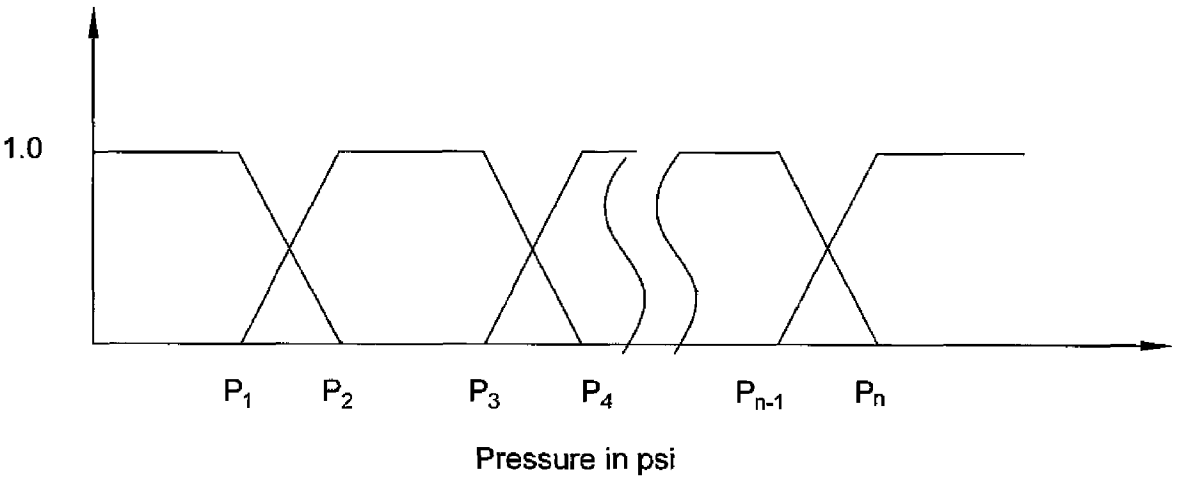
FIG. 8 is a graph illustrating fuzzy membership functions for multiple neural networks of the type illustrated in FIG. 6 used in the method for optimizing and controlling pressure in gas-oil separation plants according to the present invention.

For N neural networks, the fuzzy partition of the neural networks is illustrated in FIG. 8. Both neural networks use a single layer RBF with 60 Gaussian radial basis centers. The training of the neural networks is based on data collected from test reports. The data of the oil samples consists of 12 composition parameters up to $C^{7+}$, bubble point pressure, oil specific gravity, and reservoir temperature, in addition to the initial and final pressures and temperatures of the stage, totaling 21 input variables. The limits of the values after eliminating/correcting the outlier cases are then used to normalize the input values.

The second part of the procedure consists of applying a search procedure to find the best stage pressures $x = \{P_{s1}, P_{s2}, \ldots, P_{sM}\}$ that minimize the total predicted GOR. Similar networks are used for prediction of STO, API and FVF.

The cost function to be minimized is given by:

$$x* = \underset{x}{\text{argmin}} \{GOR_{total}, FVF, API\} = \underset{x}{\text{argmin}} J(x) \quad (6)$$

where J is a function of the stage pressures for given stage temperatures and oil composition. The function J is calculated by successively using the neural network models for the stages to estimate the stages' GOR values and summing them, along with the STO, API and FVF.

The overall method for correcting the stage pressures can be summarized as follows: (a) obtain the oil composition and the stages' temperatures from the GOSP control system; (b) update the parameters of the cost function using the stages' temperatures and oil composition; (c) apply the search algorithm to find the stage pressures which optimize the desired objective function; (d) send the estimated stage pressure to the control system and to the operator station; and (e) wait until the next update period and return to step (a).

An update period of one-half an hour or one hour is typically adequate, due to the slow time constants of such big vessels. The parameters of the neural networks may also be adaptively tuned if the actual GOR is periodically or occasionally measured. One advantage of RBF is the simple updating formula for the basis functions weight. Letting $y_{actual}$ be the measurements obtained from, for example, a lab test, letting $y_m$ be the value predicted by the RBF network when the lab test sample was taken, and letting $\phi_i$ for i=1, 2, . . . L be the radial basis outputs corresponding to $y_m$, , then the radial basis weights can be updated by the following gradient method:

$$\beta_i^{new} = \beta_i + \frac{\mu}{\sigma L}(y_{actual} - y_m)\phi_i \text{ for } i = 1, 2, \ldots L, \quad (7)$$

where $$\sigma^2 = \frac{1}{L}\sum_{i=1}^{L} \phi_i^2,$$

and $0<\mu<1$. Equation (7) provides an adaptive method for on-line tuning of the separator models.

Table 1 (in FIG. 9) shows the validation results for two test wells, A and B. The first well has two two-stage separator tests, and the second well has two three-stage tests. Starting with well A, the first test provides the GOR for an ambient temperature of 130° F. for selected stage pressure and temperatures, and the second test for an ambient temperature of 75° F. The reported GOR is given in the right-most column of Table 1. The predicted GOR using the trained neural networks at the specified test conditions is shown in the fifth column of Table 1. In this case, the reported GOR is 137, and the predicted value is 136.11. At ambient temperature of 75° F., the reported GOR is 102, while the predicted GOR at the test conditions was 113.70. The genetic algorithm found a better separator set up, which reduced the GOR to 110.78 and 78.57 at ambient temperatures of 130° F. and 75° F., respectively.

These results clearly show that the predicted values of the GOR at the test conditions are reasonably close to the measured ones within acceptable tolerance limits of typical field tests. Further, the genetic algorithm optimization identifies better separator conditions, which can lead to tangible increases in quality and quantity of the produced oil. To illustrate the optimization of the identified solution, the separator temperatures were fixed and the stage pressure was varied from 50 to 150 psi, at an ambient temperature of 75° F. The correction clearly showed the optimal result of the genetic algorithm GOR of 78.57.

The optimization problem can be solved with steps similar to those used in conventional genetic algorithms. The genetic algorithm is a well-known method for solving both constrained and unconstrained optimization problems. The algorithm is based on natural selection, the process that drives biological evolution. The genetic algorithm repeatedly modifies a population of individual solutions. At each step, the genetic algorithm selects individuals at random from the current population to be parents and uses them to produce the children for the next generation. Over successive generations, the population evolves toward an optimal solution.

With the addition of the genetic algorithm optimization block, the operator can set the desired minimum and maximum operating pressure of each stage. The genetic algorithm will then automatically generate populations of possible pressures of the stages, while the neural network acts as the cost function to be minimized, and returns to the genetic algorithm the estimated GOR. The genetic algorithm continues to search for the minimum value of the GOR and returns the optimal temperatures and pressures. Alternatively, the optimization can be executed using other search-based algorithms, such as particle swarm optimization (PSO), simulated annealing, etc. Genetic algorithms and radial basis function neural networks are each well known in the art of modeling and simulation. Examples are shown in U.S. Pat. No. 8,346,693 B2 and U.S. Patent Publication No. 2009/0182693, each of which is hereby incorporated by reference in its entirety.

It is to be understood that the present invention is not limited to the embodiments described above, but encompasses any and all embodiments within the scope of the following claims.

We claim:

1. A computer software product that includes a non-transitory storage medium readable by a processor, the non-transitory storage medium having stored thereon a set of instructions for performing optimization and control of pressure in gas-oil separation plants, the instructions comprising:

(a) a first set of instructions which, when loaded into main memory and executed by the processor, causes the processor to store oil composition and a set of stage temperature data for each stage of a multi-stage gas-oil separation plant as a data set in computer readable memory;

(b) a second set of instructions which, when loaded into main memory and executed by the processor, causes the processor to establish a vector x, wherein each element of the vector x corresponds to a pressure value of one of the stages of the multi-stage gas-oil separation plant, each said pressure value corresponding to the oil composition and the stage temperature associated with the corresponding stage of the multi-stage gas-oil separation plant, the vector x being stored in the computer readable memory;

(c) a third set of instructions which, when loaded into main memory and executed by the processor, causes the processor to establish an objective function J such that $$J = \sum_{i=1}^{Q} |y_{mi} - y_{di}|^2,$$

where Q represents a number of neural network training data points, $y_{mi}$ represents an i-th predicted output, and $y_{di}$ represents an i-th target output;

(d) a fourth set of instructions which, when loaded into main memory and executed by the processor, causes the processor to establish a set of M nonlinear radial basis functions $\phi_i(x)$, wherein M is an integer and $\phi_i(x)$ represents the i-th radial basis function, where i=0, 1, 2, . . . , M;

(e) a fifth set of instructions which, when loaded into main memory and executed by the processor, causes the processor to generate a neural network output y as $$y = \sum_{i=0}^{M} \beta_i \varphi_i(x),$$

wherein $\beta_i$ is an i-th radial basis weight and the radial basis function $\phi_i(x)$ is calculated as $$\varphi_i(x) = \exp\left(\frac{\|x - C_i\|^2}{\sigma_i^2}\right),$$

where $C_i$ represents an i-th radial basis center and $\sigma_i$ represents an i-th center spread, the neural network output y being stored in the computer readable memory and the i-th radial basis center being determined by data clustering, wherein the weights $\beta_i$ are selected to minimize the objective function J, wherein the neural network output y represents an optimal pressure vector corresponding to an optimal achievable value of the objective function J;

(f) a sixth set of instructions which, when loaded into main memory and executed by the processor, causes the processor to separate the output y into a low pressure output $y_L$ corresponding to stage pressures below 250 psi and a high pressure output $y_H$ corresponding to stage pressures between 250 psi and 3,600 psi;

(g) a seventh set of instructions which, when loaded into main memory and executed by the processor, causes the processor to calculate a stage gas-to-oil ratio GOR as $GOR=\alpha_1 y_L+\alpha_2 y_H$, wherein $\alpha_1$ and $\alpha_2$ are stage pressure dependent parameters such that $\alpha_2=0$ for a stage pressure $P_s$ less than 150 psi, $$\alpha_2 = \frac{P_s - 150}{200}$$

for a stage pressure $P_s$ between 150 psi and 350 psi, and $\alpha_2=1$ for a stage pressure $P_s$ greater than 350 psi, and $\alpha_1=1-\alpha_2$;

(h) an eighth set of instructions which, when loaded into main memory and executed by the processor, causes the processor to calculate a desired stage pressure for each of the stages of the multi-stage gas-oil separation plant to reach a desired stage gas-to-oil-ratio based upon the calculated gas-to-oil ratio;

(i) a ninth set of instructions which, when loaded into main memory and executed by the processor, causes the processor to transmit control signals to each of the stages of the multi-stage gas-oil separation plant to adjust the stage pressure therein based upon the calculated desired stage pressure;

(j) a tenth set of instructions which, when loaded into main memory and executed by the processor, causes the processor to update the radial basis weights $\beta_i$, as $$\beta_i = \beta_i + \frac{\mu}{\sigma M}(GOR_{measured} - GOR)\phi_i$$

for i=0, 1, 2, . . . , M, wherein $GOR_{measured}$ represents a gas-to-oil ratio measured at each of the stages of the multi-stage gas-oil separation plant, $\sigma$ represents a center spread such that $$\sigma^2 = \frac{1}{M}\sum_{i=1}^{M} \phi_i^2$$

and $\mu$ is a parameter selected such that $0<\mu<1$; and (k) an eleventh set of instructions which, when loaded into main memory and executed by the processor, causes the processor to return to step (e), and repeats steps (e) through (k).

* * * * *